United States Patent [19]

Heyman

[11] 4,048,937

[45] Sept. 20, 1977

[54] CARGO CARRYING VESSEL HAVING AT LEAST ONE CARGO CARRYING DECK

[75] Inventor: Klas Heyman, Goteborg, Sweden

[73] Assignee: AB Gotaverken, Goteborg, Sweden

[21] Appl. No.: 639,622

[22] Filed: Dec. 10, 1975

[30] Foreign Application Priority Data

Dec. 27, 1974 Sweden ..... 7416293

[51] Int. Cl.[2] ..... B63B 25/00

[52] U.S. Cl. ..... 114/72; 114/125

[58] Field of Search ..... 114/.5 R, .5 D, 72, 114/61, 43.5 R, 125, 256–257, 264–267; 9/1.2; 214/15 R, 14

[56] References Cited

U.S. PATENT DOCUMENTS

| | | | |
|---|---|---|---|
| 1,228,756 | 6/1917 | Fungo-Giera | 114/.5 R |
| 2,669,210 | 2/1954 | Bernhard | 114/.5 R |
| 3,289,419 | 12/1966 | McGowen, Jr. | 114/.5 D |
| 3,740,957 | 6/1973 | McKenzie | 114/72 |
| 3,745,954 | 7/1973 | Lovet | 114/.5 R |

*Primary Examiner*—Trygve M. Blix
*Assistant Examiner*—Jesus D. Sotelo
*Attorney, Agent, or Firm*—Cantor & Singer

[57] ABSTRACT

A cargo vessel suited for cargo handling in a horizontal plane has a deck and a submersible pontoon, subdivided into cells, and connected to the pontoon by a number of pillars. The pontoon can be trimmed to provide an excess of buoyant force but anchors will, during transfer of cargo, maintain the deck stable and level with an embankment. A side plating having openings, and hatches for temporarily closing the same, encloses a space between the pontoon and the deck to provide stability during a voyage.

1 Claim, 5 Drawing Figures

CARGO CARRYING VESSEL HAVING AT LEAST ONE CARGO CARRYING DECK

BACKGROUND OF THE INVENTION

Within a harbour region, or between different harbours and working places it is frequently necessary to transport heavy cargoes, for instance steel constructions, machine parts, containers, etc. When transferring the goods to a barge or vessel there arise great difficulties as to the trimming of the barge, because the barge tends to sink and also heels over. Generally, the goods are brought aboard by means of cranes. Only a few harbours are provided with feasible big lifting devices.

A great advantage would be obtained if the heavy cargoes instead could be moved in the horizontal plane, directly onto the barge or vessel without any expensive lifting arrangements. No satisfactory and simple method of maintaining the cargo supporting deck of the barge or vessel horizontally at the level of the embankment plane when the cargo is transferred is, however, available. Such operation would involve intense and time consuming trimming of the barge.

Additionally, there might be substantial and fast water level variations.

SUMMARY OF THE INVENTION

According to the invention the above mentioned problem is solved by maintaining the cargo carrying deck of a vessel stable and substantially at the level of an embankment plane, when loading and unloading the vessel. Said object is obtained in that means settable as to level are arranged for positioning at least the cargo carrying deck portion facing the embankment at a level substantially corresponding to the embankment level, and in that means are arranged for providing an excess of buoyant force, determined by the cargo to be handled, when said settable means positions said deck portion at said embankment level.

DESCRIPTION OF SOME PREFERRED EMBODIMENTS

Figure 1:
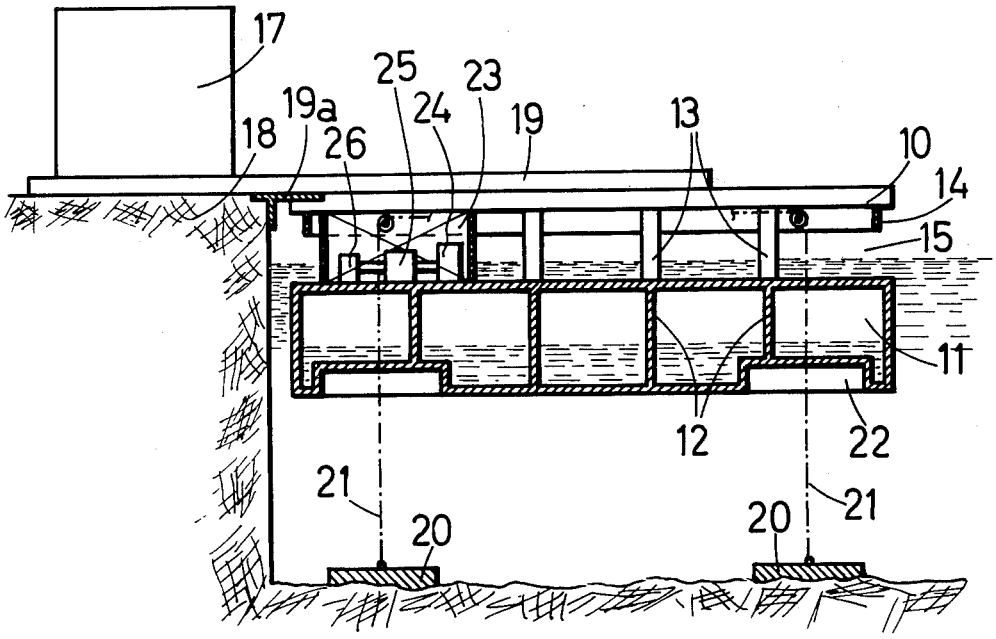
FIG. 1 shows a cross section of a barge at an embankment and during loading.

The barge shown very schematically in FIG. 1 comprises a cargo deck 10 and a pontoon 11, divided into water tight cells 12 (longitudinal and transverse). Deck 10 is supported from pontoon 11 by an appropriate number of columns, wash bulk-heads 13, and a shell-plating 14 provided with openings. The arrangement is such that the pontoon always is located below the minimum water level allowed. Thus, the buoyant force and the trim position are not affected by varying water levels and waves.

Figure 2:
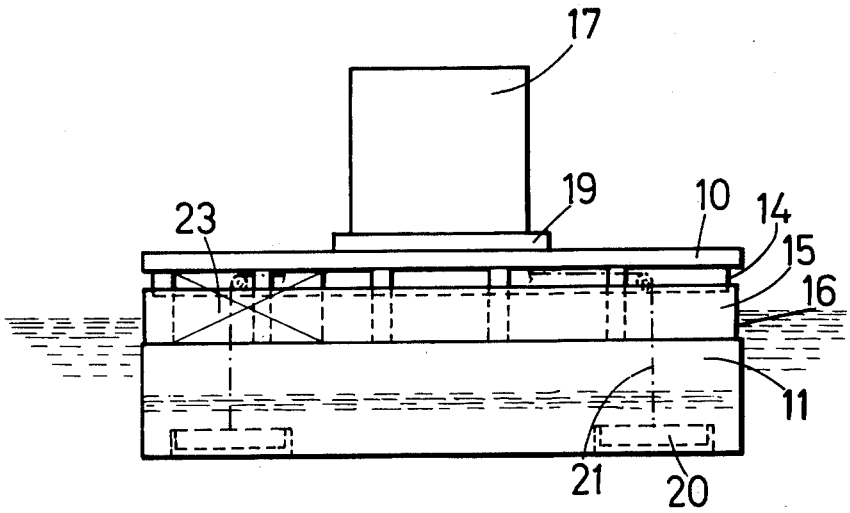
FIG. 2 shows a section of the barge in off-shore operation.

The shell-plating is provided with openings 15, which can be closed by hatches 16 (FIG. 2). When loading and unloading at an embankment, said openings in the shell-plating are fully open so water is allowed to flow unrestrictedly between the cargo carrying deck and the pontoon (FIG. 1). In off-shore operation the hatches are closed, and the water above the pontoon is removed (FIG. 2).

During the entire time period the cargo 17 is transferred, the barge should be maintained at the level of the embankment plane 18 and preferably in a horizontal position. Suitably placed beams or slide tracks 19 are used for the transfer. Countersunk plates **19*a*** can be laid into the junction between the embankment and the deck in order to facilitate the transfer.

When the barge reaches an embankment it is moored with the longitudinal side lying against the embankment.

For placing and maintaining the barge at the proper level, and preferably horizontally, the arrangement is such that big counterweights hanging in wires 21 below the bottom of the barge, and along its longitudinal sides, are lowered and laid onto the sea bottom. The hatches in the shell-plating are progressively opened simultaneously as the barge is trimmed with water for giving the wires the proper pulling force. By giving the wires the proper lengths, the deck is placed horizontally and at the same level as the embankment plane. The size of the counterweights should fall in such a range that the goods to be loaded, if possible, can be transferred without any trimming of the pontoon. The pulling force of the wires decreases progressively as the goods are transferred to the barge and the position is maintained unaffected as long as there is any pulling force to the counterweights. Meters are installed for providing a continuous reading of the wire tensions.

In the space between the working deck and the pontoon an engine and operation control room 23 is installed. In said room there are a diesel generator 24 for operating winches 25 and windlasses, pumps 21, valves and hatches, lifting devices, etc. Preferably, the barge can be provided with its own propulsion machinery since a diesel generator already is installed.

Of course, the barge is dimensioned for suitable buoyancy capacity, surface area, embankment height and varying water level. Where smaller cargoes are transferred it can be desirable to divide the counterweights and to lower only the weight that is necessary. The counterweights have to be distributed to such an extent that the bottom can withstand the surface pressure.

What has been said above concerning loading, of course also applies to the unloading of the barge. It is possible to design the barge for loading and unloading from one of its ends. Mooring of the barge at the embankment is carried out in a conventional way, perhaps combined with the transfer beams.

The barge described above does not need any predetermined places along the embankment, but can be moored practically anywhere along any embankment, and along embankments having varying height.

The idea of using counterweights can of course be applied to existing floating transport means (barges and lighters) in order to carry aboard the goods faster and more safely. The counterweight can be dragged provisionally below the bottom for off-shore operation and operated by a machinery which is brought aboard for the occasion. In old barges and lighters it is also possible to install vertical hatches for being able to trim for varying water levels.

Figure 4:
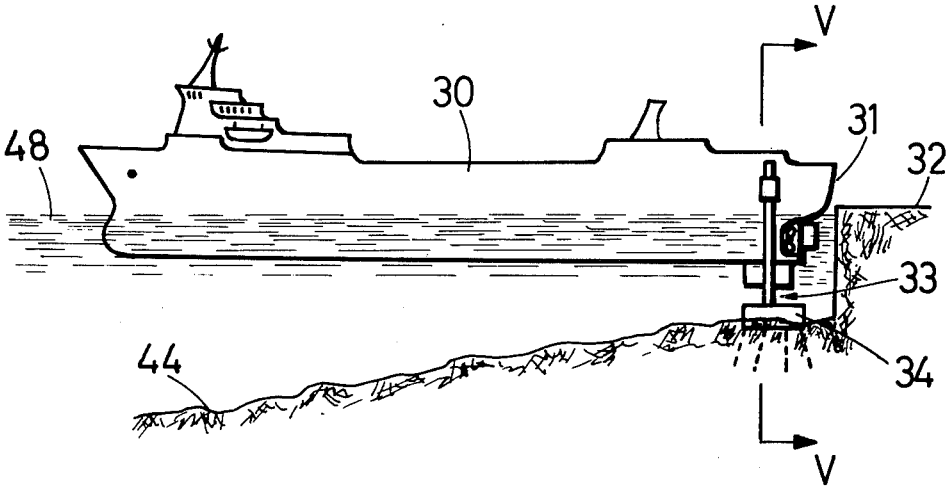
FIG. 4 shows a vessel having the stern thereof facing an embankment and being provided with an arrangement according to the invention for maintaining the deck stable when cargoes are transferred.

The vessel shown in FIG. 4 is intended for the transportation of wheeled vehicles or containers, preferably containers brought together into heavy units. For loading and unloading such units special carriages have been developed recently. In order to be able to use said carriages it is essential that the carriages, with the heavy cargo thereon, can be transferred to and from the vessel without incurring any difference between the levels of the ship deck and the embankment, respectively, and/or the vessel heeling over. For stabilizing the ship there is an arrangement, generally denoted by 33, shown in FIG. 4.

Figure 5:
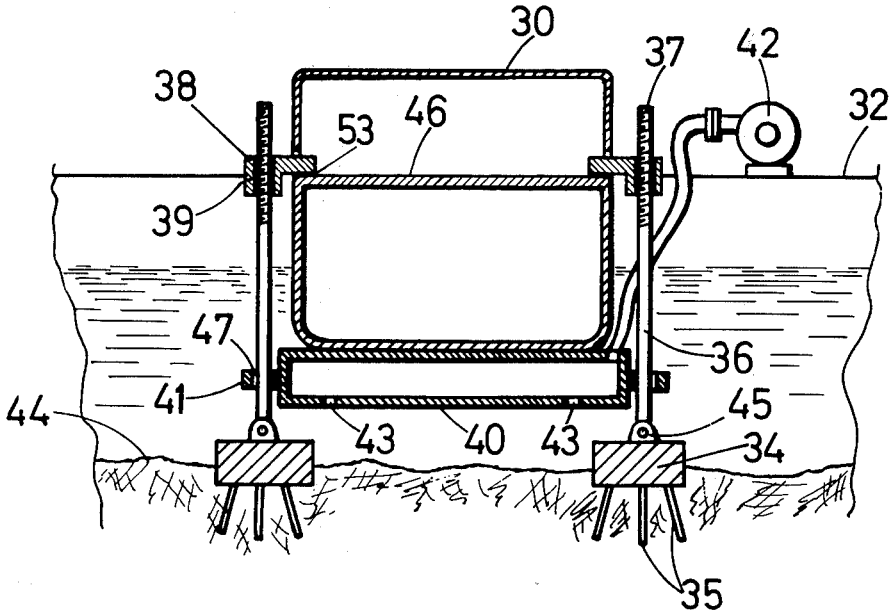
FIG. 5 is a schematic section view along the line V—V in FIG. 4.

As shown in FIG. 5, there are anchor means 34, arranged at the bottom 44 of a basin 48 outside an embankment 32. From each of the anchor means a post 36 extends upwards, and is swingable transversely with respect to the ship 30 about a pivot 45. At the top end each post is provided with threads 37 for engagement with threads of a rotatable nut 39 in a pressing member 38. For engagement with the pressing members 38 there are abutment surfaces 53 on the vessel. A pontoon 40 is arranged for sliding movement along the posts 36 and for that purpose a support 41, provided with elongated slots 47, is arranged at each end of the pontoon. When the pontoon is not used, it is resting against the anchor means 34, and is water-filled thus increasing the weight of the anchors, when used for locating a big ship having sufficient trimming capacity. For discharging water from the pontoon 40 there is arranged a pump means 42 at the embankment, and the water in the pontoon 40 can be discharged via openings 43 at the bottom of the pontoon.

The operation of the arrangement shown is the following. When the vessel 30 has obtained a position according to FIG. 4, the posts 36 are swung towards the hull, and if the cargo deck portion 46 of the vessel facing the embankment 32 is at a level higher than the embankment, nuts 39 are rotated for lowering the pressing members 38, and thus the vessel, to a level where said cargo deck portion level substantially coincides with the embankment level. If the buoyant force is not considered sufficient for the piece of cargo to be handled, pontoon 40 is evacuated by means of the pump 42, and brought to engage the bottom of the vessel, for adding the buoyant force.

If the level of the cargo deck portion 46 facing the embankment 32 is lower than the embankment level, the pressing members 38 are set at a level corresponding to the desired engagement level between the members 38 and the abutment surfaces 53, and thereafter the trimming tanks of the vessel are adjusted and pontoon 40 is operated by means of the pump 42 to bear against the bottom of the vessel for pressing the same upwards against the members 38. In this way a sufficient excess of buoyant force can be obtained for guaranteeing that the vessel deck will be maintained in a stable state, without any heeling over or level change, when the piece of cargo is brought aboard.

Other arrangements can be used for obtaining the downwardly pressing force, for instance wires, or similar can be used instead of the posts 36. Instead of having the pontoon guided by the posts, it is also possible to have separate arrangements for guiding the pontoon.

As an alternative, the pontoon can be arranged at the end of the vessel from which loading and unloading is not carried out, provided means are arranged at the other end of the vessel for positioning the cargo carrying deck at the embankment level. Hydraulics or similar can be used instead of units 39 and threads 37 on the posts 36.

Figure 3:
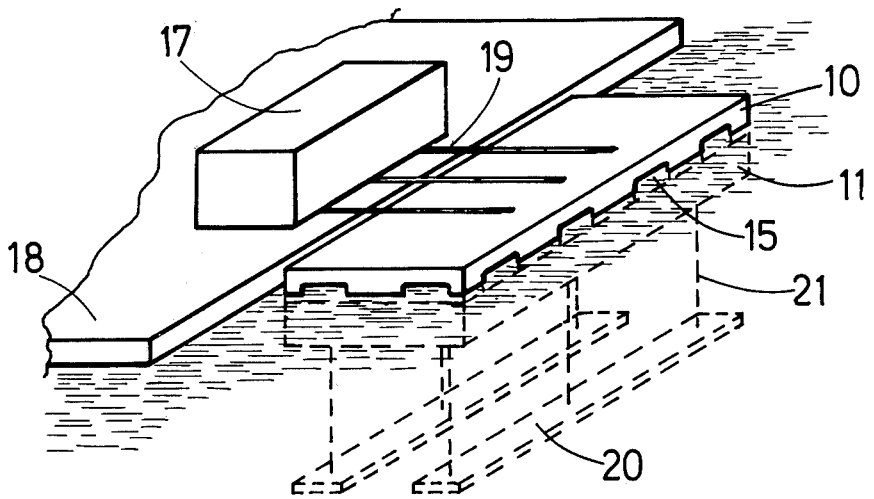
FIG. 3 shows a perspective view of a barge at an embankment.

In the embodiment according to FIGS. 1-3, the counterweights may comprise pontoons which when resting at the bottom are waterfilled. When raising the pontoons the water therein is discharged. The counterweights may be stationary when vessel is used between fixed stations. The counterweights can be divided into several units for obtaining better adaption to the bottom contour.

From the above disclosure other modifications and alternatives will be evident. Therefore the embodiments in the specification and disclosed on the drawings are not to be regarded as limiting the scope of the invention as it is set forth in the accompanying claims.

What I claim is:

1. In a cargo carrying vessel having at least one cargo carrying deck and suited for cargo handling in a horizontal plane to and from an embankment, anchors for location at the bottom of the sea below the vessel, devices for connecting said vessel to said anchors, and further means for varying the distance between said deck and said anchors, trimming tanks forming part of a pontoon divided into a number of cells and adapted during transfer of cargo always to remain below water level for providing an excess of buoyant force when positioning said at least one cargo carrying deck at a level substantially corresponding to the embankment level, a number of pillar structures connecting said pontoon with said deck, a side shell-plating enclosing a space between said deck and said pontoon, openings in said plating, means for temporarily closing said openings, and pumping means for displacing water in to and out of said cells.

* * * * *